United States Patent [19]

Singleton

[11] Patent Number: 4,991,470

[45] Date of Patent: Feb. 12, 1991

[54] SOCKET WRENCH WITH IMPROVED HANDLE

[75] Inventor: Robert P. Singleton, Birmingham, Ala.

[73] Assignee: Sidewinder Products Corporation, Birmingham, Ala.

[21] Appl. No.: 434,302

[22] Filed: Nov. 13, 1989

Related U.S. Application Data

[63] Continuation of Ser. No. 74,572, Jul. 17, 1987, Pat. No. 4,907,476, Continuation-in-part of Ser. No. 771,625, Sep. 3, 1985, Pat. No. 4,680,944, Continuation-in-part of Ser. No. 746,673, Jun. 20, 1985, Pat. No. 4,620,459.

[51] Int. Cl.[5] ..... B25G 1/00

[52] U.S. Cl. ..... 81/177.7; 81/177.2; 81/177.5

[58] Field of Search ..... 81/177.1, 177.2, 177.5–177.9, 81/58.1, 57.29, 73, 35, 37, 29, 28

[56] References Cited

U.S. PATENT DOCUMENTS

| | | | |
|---|---|---|---|
| 2,220,354 | 11/1940 | Sheets | 81/177.5 X |
| 2,572,444 | 10/1951 | Carden | 81/177.8 |
| 4,262,561 | 4/1981 | Mize | 81/58.1 X |

FOREIGN PATENT DOCUMENTS

| | | | |
|---|---|---|---|
| 383772 | 11/1932 | United Kingdom | 81/73 |

*Primary Examiner*—D. S. Meislin
*Attorney, Agent, or Firm*—Nies, Kurz, Bergert & Tamburro

[57] ABSTRACT

A speed socket wrench which substantially reduces the work required to remove nuts or bolts is disclosed. The wrench includes a bevel gear and mating bevel pinion mounted respectively on a gear shaft and pinion shaft. A drive shaft is provided on the outer end of the pinion shaft. A reversing ratchet mechanism is employed to lock the drive shaft. The specific construction and arrangement of components provides a socket wrench has been found to substantially reduce the work required to remove nuts or bolts, as compared with conventional wrenches. The present invention provides an improved T-handle for use with a tool having a shaft which rotates about its longitudinal axis. The T-handle is constructed with a generally L-shaped end member, having the shorter leg of the end member extending outwardly at an angle such as about 45 degrees and with the end member being pivotable at its center about the shaft so as to form an angle with the shaft which is complementary to the angle formed by the shorter leg of the end member with the main portion of the end member. In this manner, there is obtained a lever arm that is parallel to the shaft in the operating mode.

4 Claims, 4 Drawing Sheets

FIG. 4
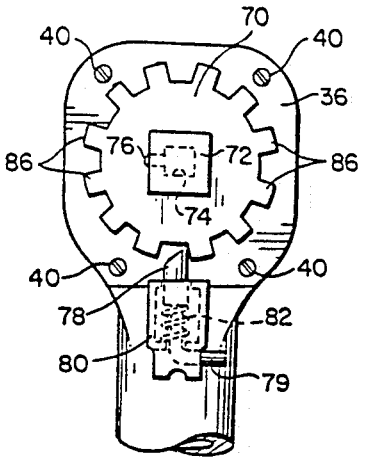
FIG. 5
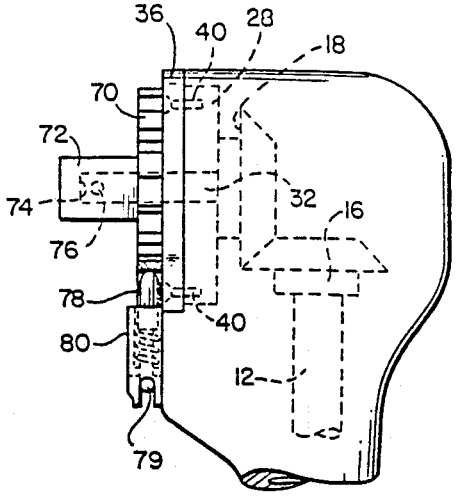
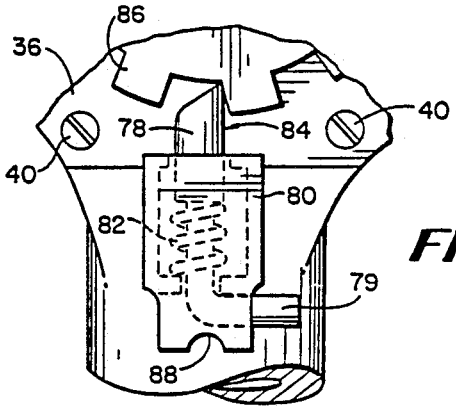
FIG. 6
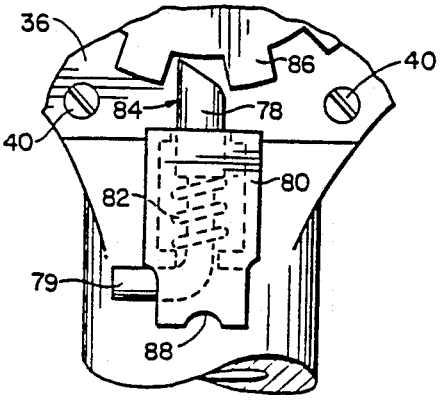
FIG. 7
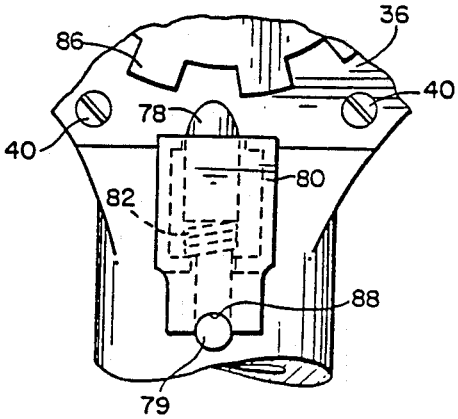
FIG. 8

SOCKET WRENCH WITH IMPROVED HANDLE

This is a division of application Ser. No. 074,572 filed July 17, 1987, which is a continuation-in-part of application Ser. No. 771,625 filed Sept. 3, 1985, now U.S. Pat. No. 4,680,994, which is a continuation-in-part of application Ser. No. 746,673 filed June 20, 1985, now U.S. Pat. No. 4,620,459.

BACKGROUND AND SUMMARY OF THE INVENTION

This is a continuation-in-part of application Ser. No. 771,625 filed Sept. 3, 1985 which is a continuation-in-part of application Ser. No. 746,673 filed June 20, 1985, now U.S. Pat. No. 4,620,459.

The present invention relates to a wrench and more particularly to a speed socket wrench which provides a compact and reliable construction which is best suited for use in places which are ordinarily inaccessible and where space is limited.

The present invention provides a wrench which will enable inaccessible nuts to be manipulated without difficulty, which can be easily and quickly adjusted and which is not subject to breakage or loss of working ability. By the present invention there is provided a wrench that is strong, durable, simple and inexpensive in construction and well adapted to the use for which it is intended.

The sidewinder wrench of the present invention is a speed socket wrench which employs a bevel gear and pinion set, each of which is attached to a shaft. The bevel gear is attached through its shaft to a T-handle and the pinion set is attached to the drive mechanism.

In one embodiment, a pair of bushings are employed on each shaft. The gear shaft, and thus the pinion shaft and drive, can be revolved by turning the T-handle while holding the wrench casing. In one embodiment, an inner and outer cap are located on the exterior of the casing adjacent the point at which the drive shaft exits the casing. These caps cooperate to provide a locking mechanism. In the locked position of the caps, the wrench can be employed as would any conventional wrench. In the unlocked position, the T-handle is rotated by hand, resulting in revolution of the drive shaft. The gears of the present wrench turn freely in either direction and gear ratios and sizes can be varied with wrench size.

In another embodiment, a reversing ratchet is employed, including a ratchet wheel which engages the drive shaft and also including means for locking the ratchet wheel so as to prevent rotation of the drive shaft.

The T-handle employed with the present wrench may be advantageously constructed with an L-shaped end member, having the shorter leg of the end member extending outwardly at an angle such as about 45 degrees and with the end member being pivotable at its center about the main shaft located in the handle of the wrench so as to form an angle such as about 45 degrees on either side of the main shaft.

The sidewinder wrench of the present invention has been found to substantially reduce the work required to remove nuts or bolts, as compared with conventional wrenches. The present wrench uses mechanical advantage in two ways rather than one way as in the case of the previous wrenches: (1) to provide torque to break or tighten the nut or bolt; and (2) to provide speed, in that with the sidewinder wrench, one turn of the handle results in two turns of the nut or bolt, whereas with existing wrenches, one turn provides $\frac{3}{4}$ or less turn of the nut or bolt.

Additional features of the wrench of the present invention include the following: (1) requires less room to operate than conventional wrenches; (2) especially effective on long bolts because of the large number of repetitions or on bolts where there is minimal resistance because other wrenches require resistance; and (3) since the wrench handle does not move, the wrench socket does not tend to slip off the nut or bolt.

BRIEF DESCRIPTION OF THE DRAWINGS

FIG. 4 is an end view of a second embodiment of the invention with reversing ratchet.

FIG. 5 is a side elevation of the embodiment of FIG. 4.

FIGS. 6 through 8 are enlarged views showing a portion of FIG. 4 relating to three positions of the ratchet pawl.

DESCRIPTION OF THE PREFERRED EMBODIMENTS

Figure 1:
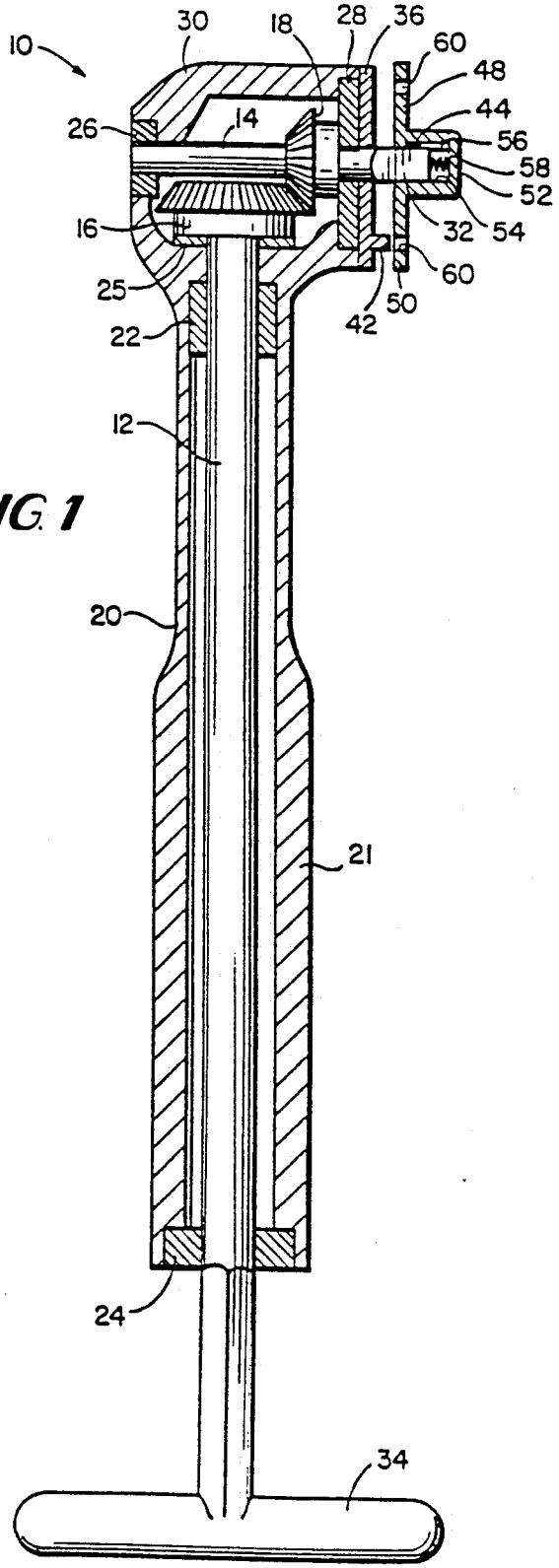
FIG. 1 is a side elevation in cross section of the sidewinder wrench of the present invention.
Figure 2:
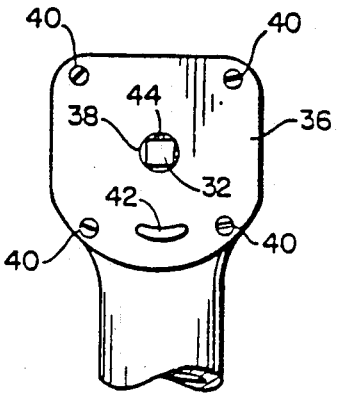
FIG. 2 is an end view of the wrench of FIG. 1, taken from the right side of FIG. 1, with the outer cap removed.
Figure 3:
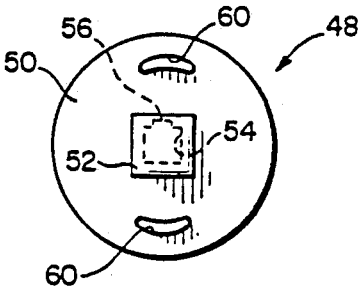
FIG. 3 is a side elevation of the outer end cap employed with the wrench of FIG. 1.

In the embodiment of the invention as shown in FIGS. 1 through 3, there is provided a speed socket wrench 10 which includes a gear shaft 12 and pinion shaft 14. A bevel gear 16 mates with a bevel pinion 18 mounted respectively on the gear shaft 12 and pinion shaft 14.

The gear shaft 12 is mounted in a casing 20 so as to be rotatable within a bushing 22, 24 mounted at each end of the casing. In a similar manner, the pinion shaft 14 is mounted within a pair of bushings 26, 28 mounted in gear housing 30 formed in the upper end of the casing 20. A drive shaft 32 is provided on the outer end of the pinion shaft 14. The bushings provide support to the respective shafts and also assist in maintaining the gears in proper mesh. The casing 20 and housing 30 provide additional support to the respective shafts to resist bending.

The gear shaft 12 is mounted at 90 degrees relative to the pinion shaft 14. Thus the gear shaft 12 and therefore the pinion shaft 14 and drive 32 can be revolved by turning a T-handle 34 mounted at the lower end of the gear shaft 12. A bushing 25 is mounted at the upper end of the shaft 12 within the housing 30 to provide a smooth surface for the bevel gear 16.

The T-handle 34 provides a mechanical advantage in torque on the shaft 12. An L-shaped handle may also be employed as described hereinafter. The handle could also be constructed of two pieces which slide back and forth to form a T or L-shape as desired, or as a two piece swivel construction. The casing 20 is sized to fit the hand on the lower end 21 where it will be held. A first or inner cap 36 in the form of a planar member having a circular central opening 38 is positioned adjacent the bushing 28 outwardly thereof and secured to the face of the housing 30 by means such as set screws 40. Where the pinion shaft 14 exits the first cap 36, the shaft 14 changes from circular cross section to square cross section. The cap 36 assures an accurate gear mesh by securing the bushing 28. Positioned in the midportion of the lower outer surface of the cap 36 is a lug member 42 which is used in locking the wrench. The lug 42, which is circular on the inner and outer curves with rounded ends to distribute the shearing forces on the lug 42, flares outwardly from its point of attachment to the cap 36 adjacent the rounded ends of the lug 42. This configuration, which results in a larger size for the lug 42 at the outer end thereof, aids in keeping the locking mechanism engaged when in use.

A hemispherical shaped stop member 44 is secured to the upper surface of the drive shaft 32 adjacent the outer end thereof. The stop member 44 fits within a channel 56 in a second or outer cap 48 which is positioned on the outer end of the drive shaft 32. The outer cap 48 includes a planar portion 50 with a central box-shaped portion 52 of square cross section extending outwardly therefrom. The outer cap 48 has a generally cube shaped inner bore 54 with channel portion 56 extending upwardly therefrom and parallel to the longitudinal axis of the shaft 32. The inner bore 54 is of a size just large enough to receive the outer end of shaft 32 as shown in FIG. 1. The channel 56 terminates at its inner end adjacent planar portion 50 and, from that point, that part of planar portion 50 which is adjacent the upper surface of the drive shaft 32 is provided with a rounded or chamfered configuration, for ease in assembling the outer cap 48 over the stop member 44.

A spring mechanism 58 is positioned in biasing relation between the outer end of the drive shaft 32 and the outer end wall of the box-shaped portion 52 of the outer cap 48. The force of the spring 58 should be sufficient to force the caps 36, 48 apart when pressure has been released on the outer surface of the cap 48 during use.

The locking mechanism is easily engaged by aligning the lug 42 on the inner cap 36 with either of the openings 60 in the outer cap 48. The openings 60 match the lug 42 in shape, being large enough to receive the outwardly tapered portion of the lug 42 which is larger than the inner portion thereof adjacent inner cap 36. By slightly pressing on the casing handle 21 with intent to push the wrench upper housing 30 directly at the nut or bolt being turned, the faces of the caps 36, 48 will move to a position flush against each other with the result that the outer cap 48 will prevent the drive shaft 32 from rotating. In this locked configuration, the wrench 10 may be used in a conventional manner by applying pressure on the casing handle 21 so as to rotate the handle 21 about the axis of the drive shaft 32.

Once locked, the wrench 10 will remain in the locked position as long as contact is maintained with the nut or bolt under pressure. This is due to the slight outwardly tapered bevel of the lug 42 and also due to the fact that the static force between the lug 42 and the opening 60 in the outer cap 48 is greatly increased by the application of force on the casing handle 21. The static friction force on the knob during use is far greater than the force of the spring 58, so that the spring 58 is only effective to unlock the caps 36, 48 when pressure of the wrench 10 against the nut or bolt has been released. As the outer cap 48 moves outwardly during the unlocking sequence, the stop member 44 will prevent the cap 48 from coming off the drive shaft 32, as the stop member 44 will impinge against the inner wall of the channel 56 as shown in FIG. 1. In this unlocked position, the T-handle 34 may be used to control the rotation of the drive 32 for use of the wrench 10 in situations in which conventional wrench operation is difficult or impossible.

The lug 42 should be positioned sufficiently below the drive 32 so as not to interfere with operation of the socket. Also, the outer cap 48 should be constructed of sufficiently resilient material to allow for engaging and disengaging of the cap 48 with the lug 42 and to allow for ease of assembly of the cap 48 relative to stop member 44.

The wrench construction of the present invention is particularly advantageous in that all the pressure is off the gears when the wrench is being used in the conventional manner.

In one embodiment, the wrench 10 of the present invention had a gear shaft 12 with a diameter of $\frac{3}{8}$ inch and a pinion shaft 14 with diameter of 3/16 inch. The square drive 32 was of $\frac{1}{4}$ inch size. In this embodiment, the bevel gear 16 had a diameter of about 1.04 inch and the bevel pinion 18 had a diameter of about 0.59 inch. The inner 36 and outer 48 caps had their planar faces of approximately 1/16 inch in thickness and the lug 42 was about 3/32 inch in length. The stop member 44 was approximately 1/16 inch in diameter and the length of channel portion 56 was approximately 5/32 inch.

In the embodiment as shown in FIGS. 4 through 8, there is provided a locking mechanism which includes a reversing ratchet wheel 70 having an outwardly extending box shaped portion 72 of square cross section. The ratchet wheel 70 and portion 72 have a bore 74 therein of square cross section, of a size just large enough to receive the square drive shaft 32. A set screw 76 is employed to secure the ratchet wheel 70 and portion 72 to the drive shaft 32.

An L-shaped ratchet pawl 78 with lower end 79 is positioned for engagement with the ratchet wheel 70, being mounted in pawl casing 80 which is secured to the face of the housing 30. The pawl 78 is free to move in the direction of its axis but is biased into engagement with the ratchet wheel 70 by a spring 82. When the pawl 78 is turned one-half revolution, as shown in FIGS. 6 and 7, the driving face 84 of the pawl 78 engages opposite sides of the teeth 86 of the ratchet wheel 70. In FIG. 8, the pawl 78 has been turned a quarter revolution and depressed into notch 88 to allow the ratchet wheel 70 to turn freely without being engaged by the pawl 70. Suitable openings in the lower end of pawl casing 80 allow the pawl 78 to be positioned as described herein.

In one embodiment, the diameter of the ratchet wheel 70 was 1 inch and portion 72 provided a 3/8 inch drive. Each of the ratchet teeth 86 was approximately 0.13 inch across and with a thickness of about $\frac{1}{8}$ inch. The gaps between teeth were about 0.131 inch and each tooth was about $\frac{1}{8}$ inch in height. In this embodiment, the diameter of the pawl 78 at the upper end was about $\frac{1}{8}$ inch.

In another embodiment of the invention, as shown in FIGS. 9 through 12, there is provided an alternative arrangement for locking the wrench 100. In this embodiment, within the wrench head 102, adjacent to the bearing plate 104 and having the same center line as the drive shaft 106, a ratchet wheel 108 with a plurality of teeth 110 is attached to the drive 106. A locking member 112 with a semicircular outline is pivotally secured within the head 102 adjacent to the ratchet wheel 108 and in a plane (with the wheel 108) to which the drive 106 centerline is normal. The locking member 112, which functions as a ratchet pawl, has two sets of two teeth 114 each on the outer surface nearest the wheel 108. Each set of teeth 114 is identical and symmetric about the centerline between the locking member 112 and the wheel 108. These teeth 114 are engageable with the teeth 110 of the ratchet wheel 108 by rotating the locking member 112 in either direction.

Figure 12:
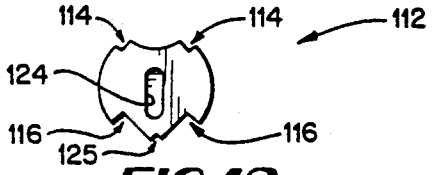
FIG. 12 is a front view of an anti-reverse mechanism employed in the embodiment of FIG. 9.
Figure 10:
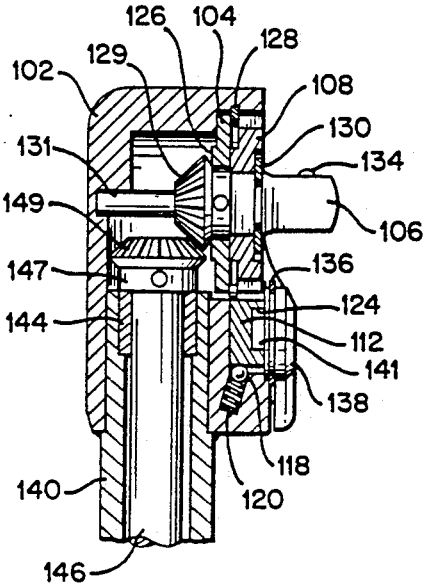
FIG. 10 is a side elevation in cross section of the embodiment of FIG. 9.
Figure 9:
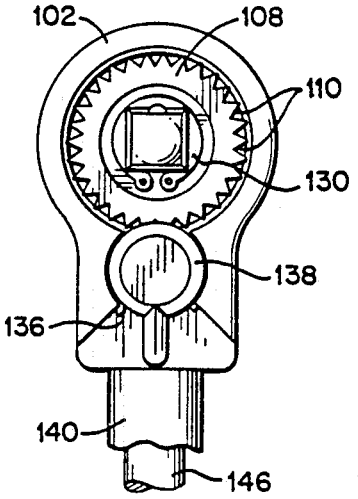
FIG. 9 is an end view of a third embodiment of the invention.

There are two channels 116 on the outer surface of the locking member 112 opposite the wheel 108, as shown in FIG. 12. Each channel 116 is identical and is symmetric about the centerline between the locking member 112 and the wheel 108. The channels 116 are positioned so that when pressure is applied by a spring loaded ball bearing 118 on the outer surface of either channel 116, the set of teeth 114 opposite that channel 116 will be engaged with the wheel 108. The spring-loaded ball bearing 118 operated by spring 120 is located in the wrench head 102 in a vertical plane which passes through the centerline of the locking member 112 and wheel 108. The wrench head 102 may be secured to the casing tubing 140 by means such as snug fitting the casing tubing 140 within the head 102 and welding the tubing 140 to the head, and with a bushing 144 being provided by press fitting between the inner end of the casing 140 and the gear shaft 146. The bushing 144 has its top surface flush with the top surface of the casing tube 140. In one embodiment, the diameter of the bushing 144 is equal to that of the gear hub 147, as shown in FIG. 10. In this embodiment, the gear hub 147 rests on the bushing 144 and the bushing 144 acts as a thrust washer to reduce the friction of turning the gear 149.

There is a vertical slot 125 in the central portion of the locking member 112 on the outer surface farthest from the wheel 108 when channels 116 are symmetric about the centerline between locking member 112 and wheel 108. The slot 125 allows the locking member 112 to stabilize in a position where neither set of teeth 114 is in contact with the wheel 108.

Figure 11:
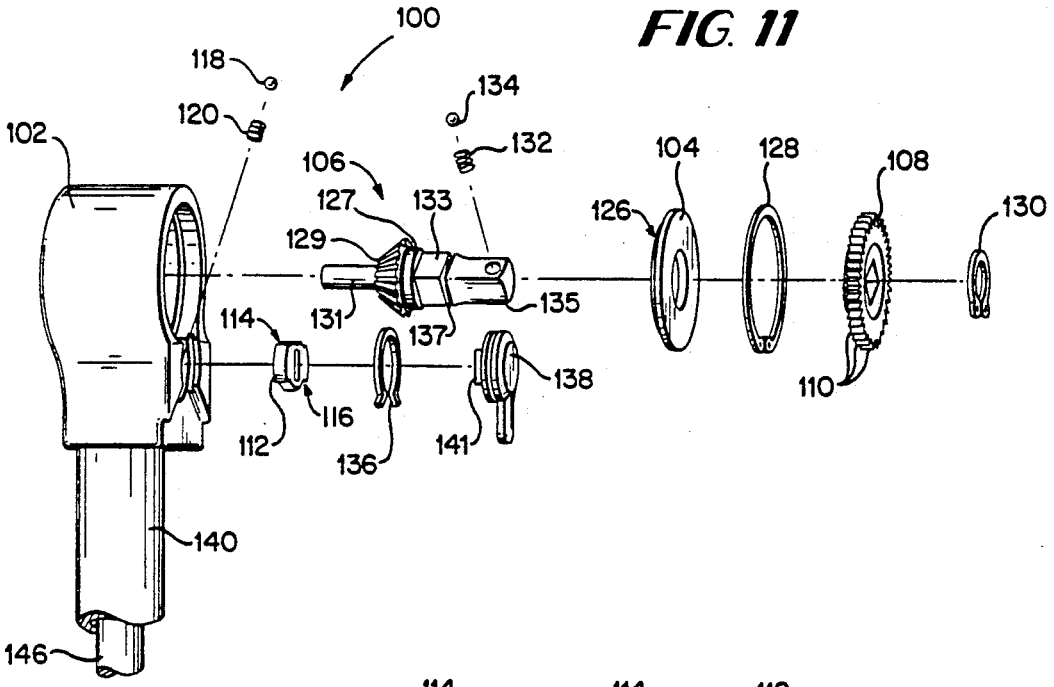
FIG. 11 is an exploded perspective view of the embodiment of FIG. 9.

As shown in FIG. 11, other components mounted on the drive shaft 106 include a bearing plate 104, having an interior portion 126 which functions as a thrust washer, a snap ring 128 between the bearing plate 104 and the ratchet wheel 108 and an additional small snap ring 130 exteriorly of the ratchet wheel 108. A detent spring 132 and ball bearing 134 are mounted in the outer end of the shaft 106 in a conventional manner.

The hub 127 of gear 129 receives the bearing plate 104, as shown in FIGS. 10 and 11. The gear 129 and gear hub 127 are secured to the inner shaft portion 131 by conventional means such as a set screw. The shaft portion 131 may be of a reduced diameter such as about $\frac{1}{4}$ inch, for example. The gear hub 127 may have a diameter such as about $\frac{1}{2}$ inch, for example. Immediately outwardly of the gear hub 127, the drive shaft 106 assumes a square cross section, with a portion 133 of relatively larger cross section and a portion 135 of relatively smaller cross section. The drive shaft 106 may be formed integrally with shaft portion 131. The shaft portion 133, which may be about $\frac{1}{2}$ inch on each side of the square cross section, receives the snap ring 128, the ratchet wheel 108 and the snap ring 130, with snap ring 130 being retained in a groove 137 in shaft portion 133. The shaft portion 135 may be about $\frac{3}{8}$ inch on each side of the square cross section and this portion 135 has the spring 132 and ball bearing 134 mounted therein. In an alternative embodiment, the shaft portions 133, 135 may be of a six sided or eight sided configuration.

Additional components which assist in operating the locking member 112 include a keeper ring 136 and a ratchet pawl lever 138 having a central lug 141 which engages the slot 124 of the locking member 112, thus allowing the pawl lever 138 to operate the locking member 112 as previously described, upon rotation of the lever 138 through a limited arc in either a clockwise or counter-clockwise direction. In one embodiment, the gears 129 and 149 were constructed with 10 teeth, straight bevel, and the ratchet wheel 108 had 32 teeth.

Figure 13:
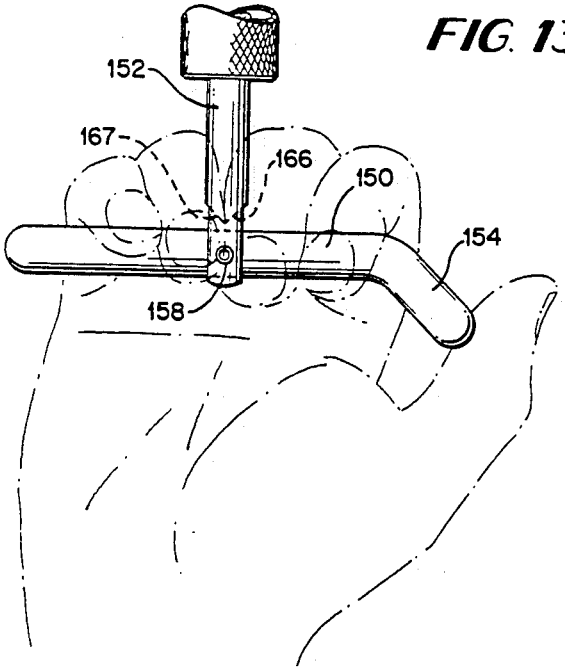
FIG. 13 is a perspective view of an alternative embodiment of a T-handle employed in the present invention.
Figure 14:
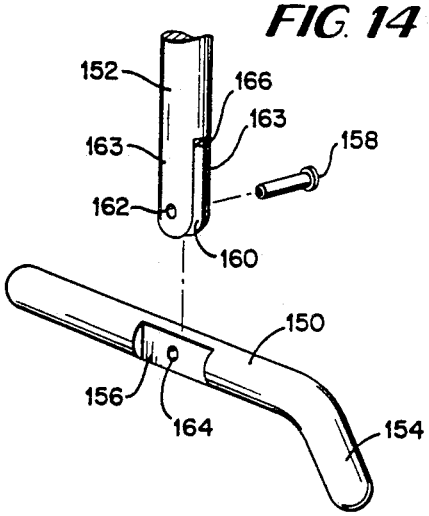
FIG. 14 is an exploded perspective view of the T-handle of FIG. 13.
Figure 15:
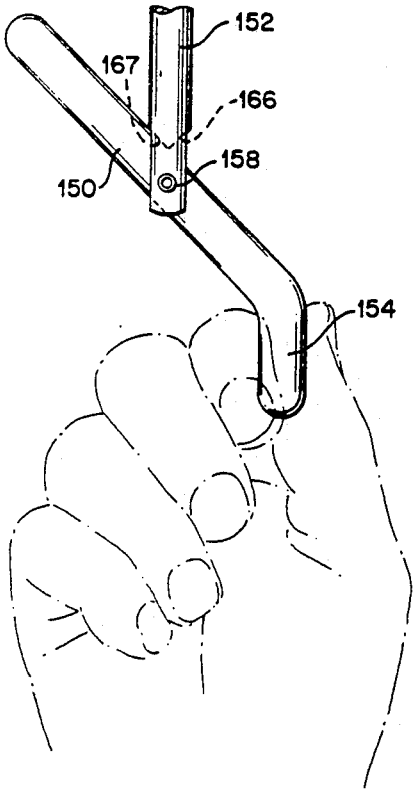
FIG. 15 is a perspective view showing the T-handle of FIG. 13 in an alternative position during operation.

In an alternative embodiment of the T-handle, as shown in FIGS. 13 through 15, by bending one end of the extended T-handle 150 at an angle such as 45° relative to an extension of the main portion of the T-handle 150, and with the T-handle 150 being mounted on the main gear shaft 152 so that it can be swiveled at an angle such as 45° relative to the main gear shaft 152, there is then obtained a lever arm 154 that is parallel to the main gear shaft 152 in the operating mode as shown in FIG. 15. Other angles may be employed, such as a 60°–30° or a 30°–60° relationship, so long as the sum of the two angles is 90°, i.e., the angles are complementary.

The T-handle 150 is rotatably mounted on the end of the gear shaft 152, as shown in detail in FIG. 14, with a central T-handle portion 156 of reduced width being mounted by means of a spring pin 158 within a central longitudinal slot 160 in the outer end of the gear shaft 152. In making this connection, the pin 158 passes through holes 162 in the parallel end portions 163 adjacent the slot 160 of gear shaft 152 and also through hole 164 which passes transversely to the T-handle longitudinal axis through the T-handle central portion 156. Use of this swivel-type arrangement allows the T-handle to be operated from awkward angles without losing the benefits of T-handle operation.

As shown in FIGS. 13 and 15, the inner end surfaces 166, 167 of the gear shaft slot 160 are angled upwardly on each side from a centerline extending transversely through the gear shaft 152, with the centerline being located in a plane which contains the longitudinal axis of the gear shaft 152 and which plane passes through the longitudinal axis of the pin 158. As indicated previously, this angle of the inner end portions 166, 167 on each side, relative to the normal to the gear shaft 152, should be selected so as to be complementary to the angle of the lever arm 154 relative to an extension of the main portion of the T-handle 150. Thus the lever arm 154 will be parallel to the main gear shaft 152 when the T-handle 150 is positioned against either of the inner end surfaces 166, 167 of the slot 160, as shown in FIG. 15. In this regard, the main portion of the T-handle 150 should be rotatably mounted on pin 158 in a position which allows the handle 150 to fit smoothly and contiguously along the respective inner end surface 166 or 167 and with the main axis of the handle 150 parallel to the respective surface 166 or 167 in the cranking position as shown in FIG. 15. This lever arm 154 can then be rotated about the main gear shaft 152, producing the desired cranking motion. A constant motion can be maintained without removing the hand from the wrench. Use of this swivel-type arrangement allows the T-handle to be operated from awkward angles without losing the benefits of T-handle operation. This embodiment has the following advantages:

1. Provides the tool with a third operating mode which can be engaged simply by adjusting the grip on the tool.
2. Does not hinder use in the other two modes.
3. Actually aids use in the other modes:
   a. Ratchet - requires less room to spin around.
   b. T-handle - actual length is longer than T-handle allowing room for hand (thumb) to grab.
4. Is especially advantageous when working on excessively long bolts or where there is minimum resistance.
5. Can be manufactured cheaply and easily.

The ratchet construction of the present invention provides the wrench with the ability to work cross threaded bolts or bolts under a bind and also allows the wrench to be worked with more ease in the locked position. The work requiring a mechanical advantage in torque is a very small percentage when compared to the mechanical advantage required in speed (percent) when removing nuts, bolts and the like. The ratchet addition enables this small percentage to be worked most effectively. Thus without removing the wrench from the nut, for example, the wrench can be "locked" in the desired direction.

The wrench of the present invention provides a more efficient use of effort than previously known wrenches. In most cases, the mechanical advantage in torque with the present invention is only needed for about one-quarter turn of the bolt while the mechanical advantage in speed is needed for the remaining turns of the bolt. The exceptions to this would be when the bolt is under a great bind, which it should not be, or when the bolt is cross-threaded, which also should not be the case.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A handle for use with a tool having an elongated shaft which rotates about the longitudinal axis of said shaft, comprising:

a transverse bar member having a main portion and being pivotally mounted at its center portion on said shaft along the longitudinal axis of said shaft adjacent one end of said shaft; at least one end portion of said bar member extending at an angle relative to the main portion of said bar member; stop means on said shaft for preventing said bar member from moving pivotally beyond a certain angle relative to the normal to said shaft, the angle of said at least one end portion of said bar member relative to an extension of said bar main portion being complementary to said certain angle, said at least one end portion thus being parallel to said shaft when said bar member engages said stop means, so that said at least one end portion will be parallel to said shaft in the operating mode.

2. The handle of claim 1 wherein said tool is a socket wrench.

3. The handle of claim 1 wherein said stop means includes a longitudinal slot in the outer end of said shaft with an inner end surface of said slot extending at said certain angle relative to the normal to said shaft, and wherein said bar member is pivotally mounted between parallel shaft end portions which define said slot.

4. The handle of claim 1 wherein said angle of said at least one end portion of said bar member and said certain angle are each 45 degrees.

* * * * *